United States Patent [19]

Hoffmann

[11] Patent Number: 4,776,522

[45] Date of Patent: Oct. 11, 1988

[54] ANNULAR GAP-TYPE BALL MILL

[75] Inventor: Karl-Heinz Hoffmann, Rommerskirchen, Fed. Rep. of Germany

[73] Assignee: Reimbold & Strick GmbH & Co., Cologne, Fed. Rep. of Germany

[21] Appl. No.: 912,546

[22] Filed: Sep. 29, 1986

Related U.S. Application Data

[63] Continuation-in-part of Ser. No. 766,111, Aug. 15, 1985, Pat. No. 4,703,896.

[30] Foreign Application Priority Data

Aug. 29, 1984 [DE] Fed. Rep. of Germany ..... 3431636

[51] Int. Cl.[4] ..... B02C 23/36

[52] U.S. Cl. ..... 241/36; 241/176

[58] Field of Search ..... 241/179, 172, 173, 176, 241/199.7, 37, 36

[56] References Cited

U.S. PATENT DOCUMENTS 3,202,364 8/1965 Wieland ..... 241/172 X
3,401,892 9/1968 Meyers ..... 241/36
4,225,092 9/1980 Matter et al. ..... 241/172 X

FOREIGN PATENT DOCUMENTS 540291 12/1931 Fed. Rep. of Germany ..... 241/179

*Primary Examiner*—Timothy V. Eley
*Attorney, Agent, or Firm*—Spensley Horn Jubas & Lubitz

[57] ABSTRACT

The annular gap-type ball mill for the continuous pulverization in particular of hard mineral substances comprises a closed grinding container (12) driven rotatingly and accommodating a rotor (13) driven in opposite direction. The outer surface of the rotor defines with the inner face of the grinding container (12) a grinding gap (20) which may contain grinding pellets.

10 Claims, 2 Drawing Sheets

ANNULAR GAP-TYPE BALL MILL

Figure 1:
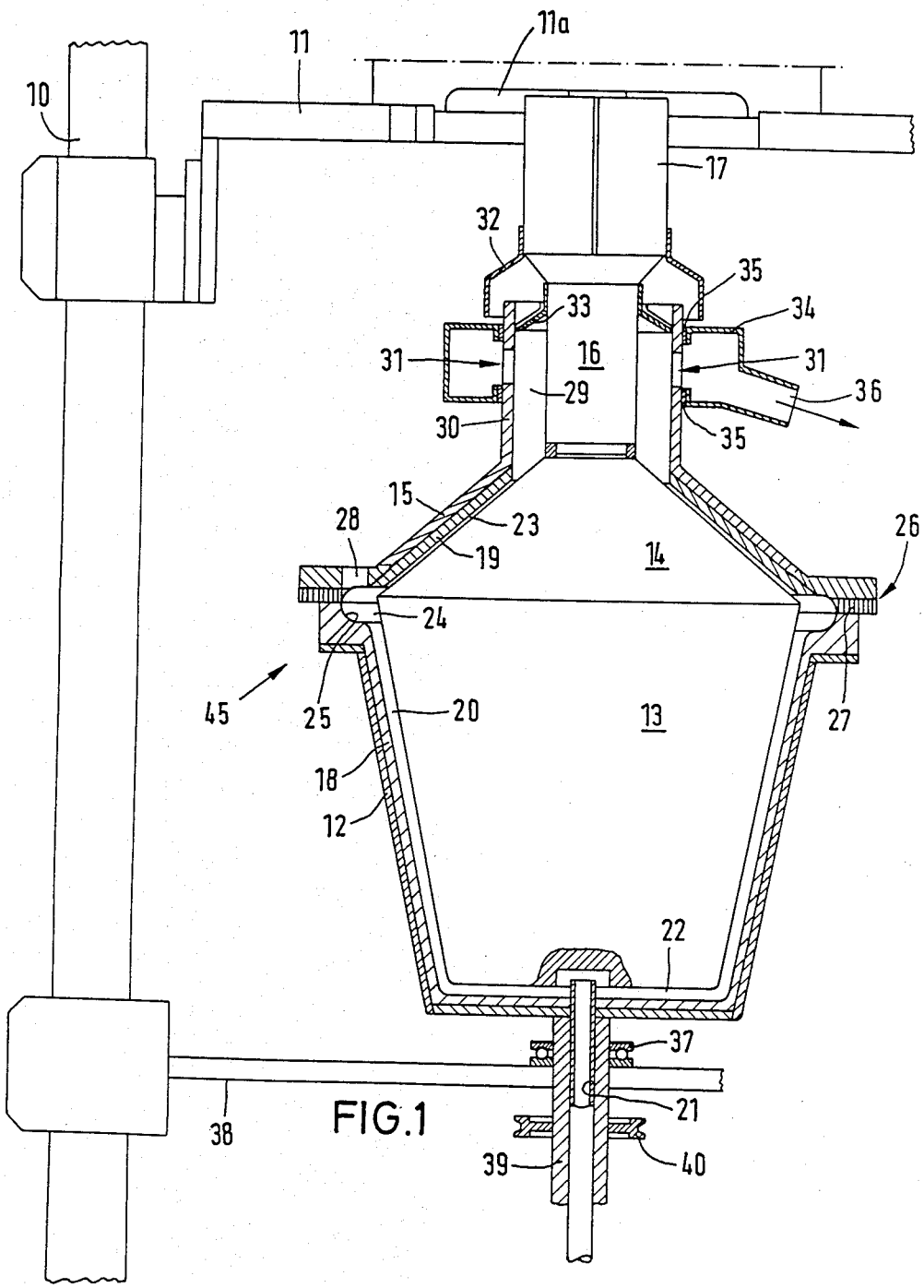

This is a continuation-in-part of Ser. No. 766,111, filed 8-15-85 now U.S. Pat. No. 4,703,896.

The invention relates to an annular gap-type ball mill for continuously pulverizing in particular hard mineral substances comprising a closed grinding container housing a rotor whose outer surface defines with the inner surface of the grinding container a grinding gap, the top portion and the lower portion of the rotor being tapered in opposite directions (according to U.S. Pat. No. 3,431,636).

Mineral hard substances (Mohs' hardness>5) such as corundum, circonium dioxide, alumina, silicon carbide and similar substances have been pulverized predominantly hitherto by iron balls in ball mills. Considerable residence times of the material in the grinding chamber are involved therewith, and all of the elements contacting the grinding material and the iron balls are exposed to a very strong wear. Further, the noise developing with the grinding operation is very disturbing. Moreover, as an additional disadvantage of such ball mills, the abrasion of the iron balls gets into the grinding material and requires chemical processes to be washed out by complicated expensive means.

Annular gap-type balls of the above mentioned type (German-laid open print No. 28 48 479) are supposed to incorporate an improvement over conventional ones, but they are less suited for the size reduction of hard mineral substances, and they are only economic in view of the comminution of considerably softer substances such as chalk or the like. This is particularly due to the behaviour of the grinding balls or pellets in the grinding gap.

While the grinding pellets pumped together with the grinding stock from below into the grinding gap first are moved up in the latter by the pressure of the feed pump by which the grinding stock suspension is pressed into the annular gap-type ball mill, and by the rotational movement of the rotor, they sink down by gravity with the decreasing pumping pressure thus excluding a grinding operation in the upper part of the grinding gap. This may be avoided by increasing the feed pump pressure or the flow of the grinding material to such an extent that the grinding pellets are kept in the upper portion of the grinding gap. This involves the risk for the grinding pellets to be discharged together with the grinding stock thus causing a reduction of the grinding output. Experience has shown that with an average flow rate of the grinding material, only the lower half of the grinding gap is more or less fully utilized for the grinding operation, while the grinding output obtainable theoretically is only half-realised. Further, the high packing density of the grinding pellets in the lower part of the grinding gap causes a high wear of the surfaces of the rotor and the grinding container. The rotor may be even blocked, in particular after a short rest period of the rotor and of the feed pump. Said risk shall be reduced with an annular gap-type ball mill of the above mentioned kind in that the lower end of the rotor is provided with an impeller which, however, only will intensify another disadvantage of the annular gap-type ball mill to the effect that the grinding pellets which do not sink down are increasingly pumped with the grinding stock to the discharge opening to thus be lost for the grinding operation. Moreover, the impeller is exposed to high wear caused by the grinding pellets and by the grinding stock. Sometimes, screens are used to retain the grinding pellets in the grinding gap; however, they inhibit the discharge of the grinding material to even stop it if they are clogged by grinding stock and grinding pellets.

According to another known annular gap-type ball mill (German laid-open print No. 28 11 899), a cone ring-shaped grinding stock container is provided whose inner face confines with a cone ring-shaped rotatable displacement body a grinding chamber. In an annular plate carrying the displacement body, return channels for the grinding pellets are fitted to extend obliquely to the outside. Also in this case, said grinding pellets show the mentioned unfavorable behaviour, and in spite of the circulation of the grinding pellets, the total height of both grinding gap parts is practically not used for the grinding operation. The grinding pellets present in the inner down-feed grinding gap portion are following rather than counteracting the grinding stock flow in discharge direction, so that the operation performed in this part of the grinding gap is even less effective than in the other portion thereof in which gravity may cause a certain longer residence time. In a probable other embodiment, the grinding container may be adapted to be driven rotatable about the center axis. However, this measure does not entail any advantages concerning an optimization of the comminution degree, but, on the contrary, the grinding pellets are driven more quickly through the grinding gap downward the inside and upward the outside so that, by their shorter residence time in the grinding gap, the grinding effect is decreased. Besides, said known annular gap-type ball mill is only suited for wet grinding, while dry material may not be treated by it.

The problem underlying the instant invention is to improve an annular gap-type ball mill of the above mentioned type so that, by an increased grinding effectivity in the grinding gap, an economically and technically perfect pulverization is possible also of hard mineral substances even in dry condition.

According to the invention, the problem is solved in that the grinding container is supported rotatably an connected to a rotary drive.

By means of an annular-gap type ball mill comprising two rotors having upper and lower portions tapered in opposite directions, any hard mineral substances such as corundum, circonium dioxide, alumina, silicon carbideetc. may be pulverized economically even in dry condition, because the total height and width of the grinding gap are used for the active grinding operation of the grinding pellets. This is due to the fact that, as a consequence of the oppositely tapered design of upper portion and lower portion of rotor and rotating grinding container, the centrifugal force (dry grinding) counteracts against the gravity of the grinding pellets thus preventing them from sinking down in the grinding gap and that the grinding pellets are kept in motion at the grinding gap outside by the grinding container and at the grinding gap inside by the rotor. As a result, the grinding gap is optimally used for the grinding operation, because even in case of a slowly moving rotor and grinding container, its total height and width are occupied by grinding pellets which, by reinforced whirling between the two rotating elements, are responsible for a high grinding efficiency. By the speed of the two rotating elements, the grinding effect is determined through an influence on the grinding pellet speed in the grinding gap, so that by a speed control, an adaptation to the grinding stock may be realised while the discharge of the grinding pellets out of the grinding gap is avoidable as well. The discharge of the grinding pellets together with the grinding stock is effectively inhibited by the high centrifugal forces at the equatorial zone of maxi diameter thus doing away with a screen or the like, and the pulverized stock freely leaves the grinding gap towards the outlet opening. The grinding stock moved upwardly through the grinding gap between rotor and grinding container top portion to the outlet opening practically does not contain any grinding pellets thus excluding a subsequent separation of grinding pellets from grinding stock. The residence times involved with the annular gap-type ball mill of the invention are longer because the used peripheral speeds of the rotor and the grinding container may be lower. The grinding stock between the grinding pellets thus moves very slowly in upward direction, the resultant grain spectrum of the grinding material being narrow. It is possible for the annular gap-type ball mill of the invention to operate extremely satisfactorily with the use of grinding pellets of varying sizes, the coarse, heavier grinding pellets preferably grinding coarse portions of the stock in the lower part of the grinding gap while the finer, lighter grinding pellets preferably grind finer stock portions in the upper grinding part because centrifugal force and uplift of the lighter particles increase in upward direction. With a sufficiently long residence time of the material in the grinding gap, the hard material is shortly ground to powder of a desired fineness and discharged in a continuous flow. Corresponding to the higher filling in the grinding gap, the energy supplied to the rotor and to the grinding container may be better utilized and the operation of the annular gap-type ball mill is more economic.

In an advantageous embodiment of the invention, the rotor and grinding container are driven in opposite directions. Due to the additional whirling of the grinding pellets and of the grinding stock in the grinding gap, and, in particular, in the equatorial zone, it is possible this way to obtain nearly double the output of an annular gap-type ball mill operating with a rotor and a stationary grinding container.

If opposed rotation of the outer body (grinding container plus cover)is additionally initiated, there is a partial reversal of movement of the pellets in the grinding gap. The grinding stock having rotated evenly in the direction of rotation of the inner rotor up to this moment, the grinding stock in the lower part of the grinding gap now starts rotating in the direction of rotation of the outer body. In the upper part of the grinding gap the original sense of rotation of the pellets is preserved. Between both packs of pellets there is formed a ca. 10 mm-wide area of reversed rotation in which the pellets are less densely packed and almost come to a standstill. Accordingly, the shear rate essential for the grinding effect is hereby situated in the lower part of the grinding gap practically at the wall of the inner rotor and in the upper part of the grinding gap at the wall of the outer body. With increasing speed of the outer rotor, the position of the described reversal of direction of rotation is raising upwards.

In the area of the discharge opening above the inner rotor the fluid is subjected to a reversal of the direction of rotation which goes along with the formation of whirls. Grinding pellets entering this area remain trapped in these whirls.

If the direction of rotation of the outer body is the same as the direction of rotation of the inner rotor, this results in a change of behaviour of the grinding pellets in the mill.

If, for example, the inner body rotates with 2080 rotations per minute, the grinding pellets are carried far into the discharge area. If now the outer body is rotated in the same direction, a speed of the outer body of only 170 rotations per minute is sufficient to keep free the discharge area of grinding pellets.

As the speed of the outer body is increased, the discharge gap is almost free of grinding pellets.

By the centrifugal force acting upon the charge of liquid the liquid level in the discharge area is raised.

By the outer body rotating along at a low speed a centrifugal acceleration is built up in the discharge gap, which acceleration acts upon the whole volume of liquid in the gap and is not lowered to zero within special areas (outer wall). Therefore, all grinding pellets are subjected to an acceleration power greater than the acceleration due to gravity, which acceleration power like a centrifugal machine divides the filling of the dividing gap into light and heavy parts and thus very efficiently separates the grinding pellets.

A grinding pellet running along at the outer wall is hereby subjected to an acceleration 3.8 times the acceleration due to gravity which leads to a speedy separating even in washes of high density Furthermore, the separating process in the discharge gap is not hindered by the formation of whirls.

The inner rotor may be out of operation. If so, the centrifugal force produced by the grinding container effective as an outer rotor is sufficient to achieve the disclosed effects during the dry grinding.

It turned out to be advantageous that, for changing the grinding gap width, rotor and grinding container are supported to be displaceable. Preferably, the displacements are effected transversely to the central axes of rotor and grinding container to reduce one side of the grinding gap, or, due to possible coaxial displacements, the grinding gap is reduced at the top or at the bottom. An excellent performance of the grinding pellets pressed through the throat of the grinding gap is possible due to the accumulation of grinding stock and grinding pellets in said throat. It may be advisable to use different grinding gap constrictions in view of an adaptation to the hard mineral substance to be ground. The displacement may be achievable during the rotation of the rotor and/or grinding container to change eccentricity of both members during the grinding operation and to cause an additional increase in performance. The center axes of rotor and grinding container may be inclined at an angle relative to each other and/or to the vertical line to thus improve the separation of grinding stock from ginding pellets at the outlet of the grinding stock because by the centrifugal force, the grinding pellets are kept beneath an upper outlet for the grinding stock. Many variations are possible by combining the change of the grinding gap width and the position of the center axes relative to each other.

Further advantageous embodiments of the invention are included in claims 6 to 9. They also contribute to an increase in efficiency of the annular gap-type ball mill and permit to pulverize dry and wet hard substances.

The inner face of the rotatable grinding container and the outer surface of the rotor are of a finely rough condition. This means that they should not be either very smooth or very rough. Such finely rough condition may be obtained by a suitable coating of the surfaces serving as a protective layer against corrosion and wear. To avoid thermal accumulations, the rotor may be ventilated inside. Further, the grinding container may be enclosed by a cooling fluid jacket.

Figure 2:
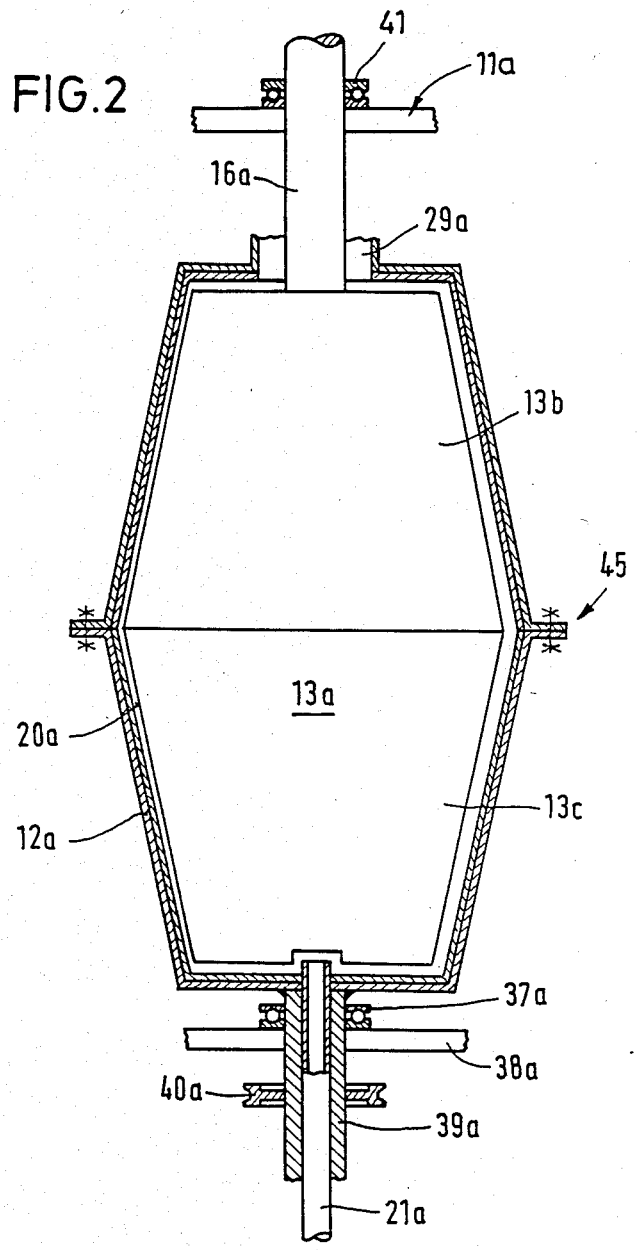

Embodiments of the invention are schematically illustrated in the drawing in which FIG. 1 is a longitudinal section of an annular gap-type ball mill and FIG. 2 is a schematic longitudinal secion of an annular gap-type ball mill having a changed grinding grinding gap shape, the annular chamber in the region of the equatorial zone of largest diameter not being provided in this case.

At an optional support 10 and via an arm 11, a displaceable motor bearing 11*a*, a motor 17 and a drive shaft 16, there is suspended rotor 33 of an annular gap-type ball mill 45 which substantially consists of a rotatably supported grinding container 12 and of rotor 13, the grinding container 12 and rotor 13 being composed each of a top portion and of a lower portion tapered frustoconically straight-facedly in opposite directions. The height of the top portions is inferior to that of the lower portions. A cover 15 is fitted in slightly spaced relationship to the top portion 14 of the rotor 13 and detachably mounted as top element on the lower portion of the grinding container 12. Said cover is adapted to the conical inclination of the top portion 14 of rotor 13. The upper end of the top portion 14 engages the drive shaft 16 supporting the rotor 13 to be free-floating in the grinding container 12 and transmitting the drive of motor 17 to rotor 13. The drive of the grinding container 12 fixed via a mounting 38 to a bearing 37 is performed through a belt pulley 40 at the lower end of a hollow shaft 39 in countersense to rotor 13. The total inner surface of the grinding container 12 with cover 15 is provided with a wear- and corrosion-resisting lining 18, 19 which is provided with afinely roughened surface. The outer surface of rotor 13 with top portion 14 is fitted with a corresponding finely roughened surface not drafted for the sake of clarity.

Between the outer face of the lower portion of rotor 13 and the inner surface of the lower portion of the grinding container 12, a parallel-walled annulargrinding gap 20 communicates through a horizontal interspace 22 between the plane bottoms of the grinding container 12 and rotor 13 with a lower central feed aperture 21 for the grinding stock. A discharge gap 23 also being parallel-sided is situated between the top portion 14 and the cover 15 or its lining 19. The width of said gap extending over the total height of the top portion 14 is inferior to the width of the grinding gap 20. The lower end of the downwardly divergent discharge gap 23 and the upper end of the upwardly divergent grinding gap 20 extend into a radial annular chamber 24. Its upper and lower walls are plane and provided in parallel relationship. Its outer end face 25 extends in a convex curvature. The chamber 24 being situated on the partition joint between cover 15 and lower portion of the grinding container 12, it ray be opened by the removal of cover 15. A spacer 27 inserted into the partition joint 26 may be exchanged against a spacer of a different thickness to change the width of the grinding gap 20 and to thus lift or lower to a higher or lesser extent the grinding container 12 relative to rotor 13. The chamber 24 is accessible through an opening 28 in the cover flange. Through said opening 28, grinding pellets may be introduced into the grinding gap 20 if rotor 13 and grinding container 12 are rotating and when, through the feed aperture 21, hard mineral substances to be comminuted have been introduced from below into the grinding gap 20.

Drive shaft 16 extends through a discharge chamber 29 in a piece 30. The wall of said piece 30 contains discharge openings 31 for the pulverized material which is pressed from the discharge gap 23 into the discharge chamber 29. The upper end of piece 30 is provided with flexible seals 32,33. A stationary ring channel 34 adjoined to the piece 30 by means of sealing lips 35 receives the grinding stock to discharge it through the outlet pipe 36.

If the annular gap-type ball mill 45is operated, motor 17 first rotates rotor 13, and the grinding container 12 is driven in opposite direction. Subsequently, grinding stock is introduced through the feed aperture 21 in the hollow shaft 39 into the grinding gap 20, and, thereafter, grinding pellets are added through the opening 28 which may consist of the same material as the stock to be comminuted to ensure that the wear of the grinding pellets does not contaminate the grinding stock and to obtain substances of high purity. The maximum peripheral speed being achieved in the equatorial zone of maxi diameter due to the oppositely conical design of the rotor 13 and of the grinding container 12, the centrifugal force prevents the grinding pellets from sinking down in the grinding gap 20. A surplus of grinding pellets is collected in chamber 24 with the resultant formation of a barrier layer which avoids a discharging of the grinding pellets through the grinding gap 20. Due to the grinding pellets present in the grinding gap 20, the latter is filled in its total height so that 100% of the gap are used in favor of the grinding operation, the grinding stock being exposed to a maximum grinding attack during its residence time in gap 20. Grinding pellets which, by wear, have been reduced such as to fit into the discharge gap 23, are recycled into chamber 24 by centrifugal force so that the powder discharged from the discharge openings 31 does not contain any grinding pellets and is available in its final desired condition without the need of an aftertreatment such as washing or screening.

The grinding pellets being reliablyhindered in the grinding gap from being sedimented, any risk concerning starting difficulties or blocking is excluded for the rotor. Thus, the wear of the elements is correspondingly low. Low energy inputs permit high grinding outputs for hard mineral substances, the duration of the residence time of the material in the grinding gap being adjustable by a corresponding selection of the peripheral speeds of rotor and grinding container and of the width of the grinding gap. The degree of comminution may be influenced by the size of the grinding pellets which, if necessary, may optionally vary thus achieving a stepwise pulverization because coarse grinding pellets in the lower portion of the annular gap-type ball mill preferably are responsible for grinding coarse pieces,-while the finer grinding pellets in the upper portion preferably pulverize the finer pieces.

In the embodiment of FIG. 2, the reference numerals of parts approximately in agreement with the embodiment of FIG. 1 are supplemented by "a". The design of the annular gap-type ball mill 45 of FIG. 2 is different from that of FIG. 1 in that the grinding gap 20*a* substantially extends over the total height of the oppositely frustoconically tapered rotor 13*a* and grinding container 12*a*, the height of the top and lower portions 13*b*, 13c being more or less equal. Further, chamber 24 does not exist. It is not required because, in case of an adequate speed of rotor 13a and of grinding container 12a, the grinding pellets are maintained by centrifugal force in the equatorial zone to cause there a reinforced grinding effect. Further, the effectivity is still increased in that via bearing 11a, rotor 13a is displaced in the grinding container 12a in transverse direction to its axis of rotation 16a (i.e. to the left in the drawing) so that one side of the grinding gap 20a is narrower than the other. Grinding stock and grinding pellets are accumulated in the narrow gap portion, and in case of a continuous upward movement of the grinding stock, the grinding effect is increased in the direction of discharge. Subject to the hardness of the grinding stock and to the peripheral speeds of rotor and grinding container, it is also possible to abstain from adding grinding pellets and to allow an autogenous grinding i.e. a grinding of the grinding stock by itself. The drive of rotor 13a is transmitted from a motor to a belt pulley 41 mounted on the drive shaft 16a. The grinding container 12a is supported rotatably in a bearing 37a connected to a mounting 38a and encompassing a hollow shaft 39a which carries a drive pulley 40a. The hollow shaft 39a is traversed by a feed line 21a ending in the lower region of the grinding gap 20a The axes of rotation of rotor 13a and grinding container 12a may be inclined relative to the vertical line.

It is possible to provide an automatic interval switch system by which the grinding container 12a and the rotor 13a are first driven in the same sense of rotation. If the maximum speed is reached, the rotor 13a or the grinding container 12a are caused to be displaced relative to each other so as to obtain a unilateral grinding gap 20a of 1 mm, while, at the same time, the grinding container 12a or the rotor 13a are changed over to be operated in opposite directions. Subsequently, the grinding container 12a or the rotor 13a are returned to the initial position with the same sense of rotation, and the mentioned performance is repeated. This procedure is particularly recommendable in case of an autogenous grinding to obtain a high energy density in the reduced grinding gap.

What is claimed is:

1. An annular gap-type ball mill for continuously pulverizing hard mineral substances, comprising:

a rotatable closed grinding container and a cover, said rotatable grinding container and said cover being tapered in opposite directions, said rotatable grinding container having an inner surface;

a rotor housed in said closed grinding container, said rotor having a top portion and a lower portion that are tapered in opposite directions, said rotor also having an outer surface which defines a grinding gap with said inner surface of said closed grinding container;

pellets contained in said grinding gap; and a rotary drive means for imparting a rotational force on said closed grinding container, for rotating said clsoed grinding container in a first direction of rotation.

2. An annular gap-type ball mill as defined in claim 1, further comprising:

drive means for rotatably driving said rotor in a second direction of rotation, opposite to said first direction of rotation.

3. An annular gap-type ball mill as defined as claim 1 further comprising:

displacement means for displaceably supporting at least one of said rotor and said closed grinding container so as to be dispalceable with respect to the other of said rotor and said closed grinding container;

whereby the displacement of at least one of said rotor and said closed grinding container changes the width of said grinding gap.

4. An annular gap-type ball mill as defined in claim 1, wherein said rotor and said closed grinding container each have a central axis, and wherein the central axis of said rotor is angled with respect to the central axis of said closed grinding container.

5. An annular gap-type mill as defined in claim 1, wherein said rotor and said closed grinding container each have a central axis, and wherein said central axis of at least one of said rotor and of said closed grinding container is inclined relative to the vertical line.

6. An annular gap-type ball mill as defined in claim 1, further comprising:

drive means for rotatably driving said rotor in said first direction of rotation.

7. An annular gap-type ball mill for continuously pulverizing hard mineral substances, comprising:

a rotatable closed grinding container having an inner surface;

a rotor housed in said closed grinding container, said rotor having a top portion and a lower portion that are tapered in opposite directions, said rotor also having an outer surface which defines a grinding gap with said inner surface of said closed grinding container;

pellets contained in said grinding gap; and a rotary drive means for imparting a rotational force on said closed grinding container, for rotating said closed grinding container in a first direction of rotation;

displacement means for dispalceably supporting at least one of said rotor and said closed grinding container so as to be displaceable with respect to the other of said rotor and said closed grinding container;

whereby the displacement of at least one of said rotor and said closed grinding container changes the width of said grinding gap, and wherein said displacement means is operable for displacing at least one of said rotor and said closed grinding container during the rotation of said rotor and of said closed grinding container.

8. An annular gap-type ball mill for continuously pulverizing hard mineral substances, comprising:

a rotatble closed grinding container having an inner surface;

a rotor housed in said closed grinding container, said rotor having a top portion and a lower portion that are tapered in opposite directions, said rotor also having an outer surface which defines a grinding gap with said inner surface of said closed grinding container;

pellets contained in said grinding gap; and a rotary drive means for imparting a rotational force on said closed grinding container, for rotating said closed grinding container in a first direction of rotation;

displacement means for displaceably supporting at least one of said rotor and said closed grinding container so as to be displaceable with respect to the other of said rotor and said closed grinding container;

whereby the displacement of at least one of said rotor and said closed grinding container changes with width of said grinding gap, and an automatic interval switch for repeatedly changing the direction of rotation of at least one of said rotor and of said closed grinding container, and for causing the displacement of said rotor relative to said closed grinding container.

9. An annular gap-type ball mill as defined in claim 8, wherein said automatic interval switch system comprises:

means for repeatedly causing said closed grinding container and rotor to be driven in the same direction of rotation and, upon reaching a predetermined maximum speed, for causing relative displacement of said rotor and said closed grinding container to obtain a unilateral grinding gap of substantially 1 mm and for simultaneously causing said closed grinding container and said rotor to be driven in opposite directions of rotation, and for subsequently returning said closed grinding container and said rotor to the initial position and direction of rotation.

10. An annular gap-type ball mill according to claim 9, further comprising:

a hollow drive shaft connected with said closed grinding container; and an inlet for the grinding stock;

wherein at least one of said rotor and said closed grinding container incudes a central passage having an open end in said grinding gap, in communication with said hollow drive shaft, and joined to said inlet for the grinding stock.

* * * * *